United States Patent [19]

Cain et al.

[11] Patent Number: 5,031,695

[45] Date of Patent: Jul. 16, 1991

[54] WELL CASING HANGER WITH WIDE TEMPERATURE RANGE SEAL

[75] Inventors: David E. Cain, Houston; Ronald W. Henley, Kingwood; Kevin P. Long, Houston; Tep Ungchusri, Woodlands, all of Tex.; John C. Vicic, Santa Cruz, Calif.

[73] Assignee: FMC Corporation, Chicago, Ill.

[21] Appl. No.: 502,465

[22] Filed: Mar. 30, 1990

[51] Int. Cl.[5] ..... E21B 19/10; F16L 21/00

[52] U.S. Cl. ..... 166/75.1; 166/208; 285/146; 285/147; 285/144

[58] Field of Search ..... 166/75.1, 208, 217, 166/82, 86, 88; 285/141, 144–148

[56] References Cited

U.S. PATENT DOCUMENTS

| | | | |
|---|---|---|---|
| 2,689,139 | 9/1954 | Jones et al. | 285/146 |
| 2,920,909 | 1/1960 | Allen | 285/147 |
| 3,011,806 | 12/1961 | Allen et al. | 285/147 |
| 3,038,745 | 6/1962 | Cooke, Jr. | 285/148 |
| 3,068,027 | 12/1962 | Lewis et al. | 285/144 |
| 4,790,379 | 12/1988 | Vanderford, Jr. | 285/146 |
| 4,913,469 | 4/1990 | Baugh | 285/146 |

*Primary Examiner*—Bruce M. Kisliuk

*Attorney, Agent, or Firm*—W. William Ritt, Jr.; Richard B. Megley

[57] ABSTRACT

A well casing hanger with a wide temperature range seal element that is energized by axial compression with a pre-determined initial portion of the casing hang load, the remaining portion of that hang load then being transferred to the wellhead or other surrounding well element without imposition on the seal element.

8 Claims, 2 Drawing Sheets

WELL CASING HANGER WITH WIDE TEMPERATURE RANGE SEAL

BACKGROUND OF THE INVENTION

This invention relates to well casing hangers, and more particularly to such hangers for use by the petroleum industry in wells under wide temperature range conditions.

As the petroleum industry continues to develop producing oil wells in increasingly severe environments, the requirements published by the American Petroleum Institute for safely controlling downhole pressures existent at the wellhead continue to become more demanding. Furthermore, the operating petroleum companies desire equipment which can be installed and sealed off as quickly and reliably as possible, and these requirements and preferences are difficult to satisfy with existing casing hangers. Effecting an annulus seal with an elastomeric seal element over wide temperature ranges, such as zero degrees F. to 275 degrees F., and minus 50 degrees F. to 180 degrees F., while supporting the suspended casing load has not been achieved with hangers prior to the present invention, usually because of the difficulty in allowing for the thermal expansion and contraction of the seal element which has a coefficient of thermal expansion about ten times greater than that of the steel elements of the hanger.

For maximum safety under the foregoing conditions the annulus seal should be effected automatically as soon as the casing load is hung off in the hanger, and excessive deformation of the casing, which would restrict the free bore drift of the casing, should be prevented. Also, when pressure is applied to the annulus the radial load on the slips should not increase. And, to further complicate the matter, the American Petroleum Institute has recently changed the allowable outside diameter tolerance for casing, thereby requiring hangers to operate with casing according to either revision of that Institute's specification number 5B.

The foregoing problems are solved, and the aforesaid requirements and preferences are satisfied, by a casing hanger embodying the present invention as described below and illustrated in the accompanying drawings.

SUMMARY OF THE INVENTION

The present invention comprises a well casing hanger assembly including a plurality of arcuate slips with inner and outer toothed surfaces, a slip bowl with a frusto-conical inner surface against which the slips reside, a false bowl surrounding the slip bowl and having an upper end portion that forms a lower junk ring, an upper junk ring, and an annular elastomeric seal element residing between the lower and upper junk rings, the seal element having a unique cross-sectional configuration that is deformed by application of the casing hang load to energize the seal element and effect a bi-directional fluid-tight barrier between the casing and a casing head or other outer element in which the hanger is supported. The seal element has inner and outer circumferential portions interconnected by a central web portion of less axial dimension than the inner and outer portions and having concave upper and lower radial surfaces, and the inner and outer axial surfaces of the seal element are cylindrical with upper and lower chamfered edges. The assembly elements cooperate to deform and energize the seal element a pre-determined amount regardless of the casing hang load, and to then transfer that hang load from the casing directly through the slips, slip bowl and false bowl onto the casing head. The hanger facilitates establishing and maintaining the bi-directional seal over wide ranges of temperature heretofore not achieved by known prior hangers.

DESCRIPTION OF THE PREFERRED EMBODIMENT

Figure 1:
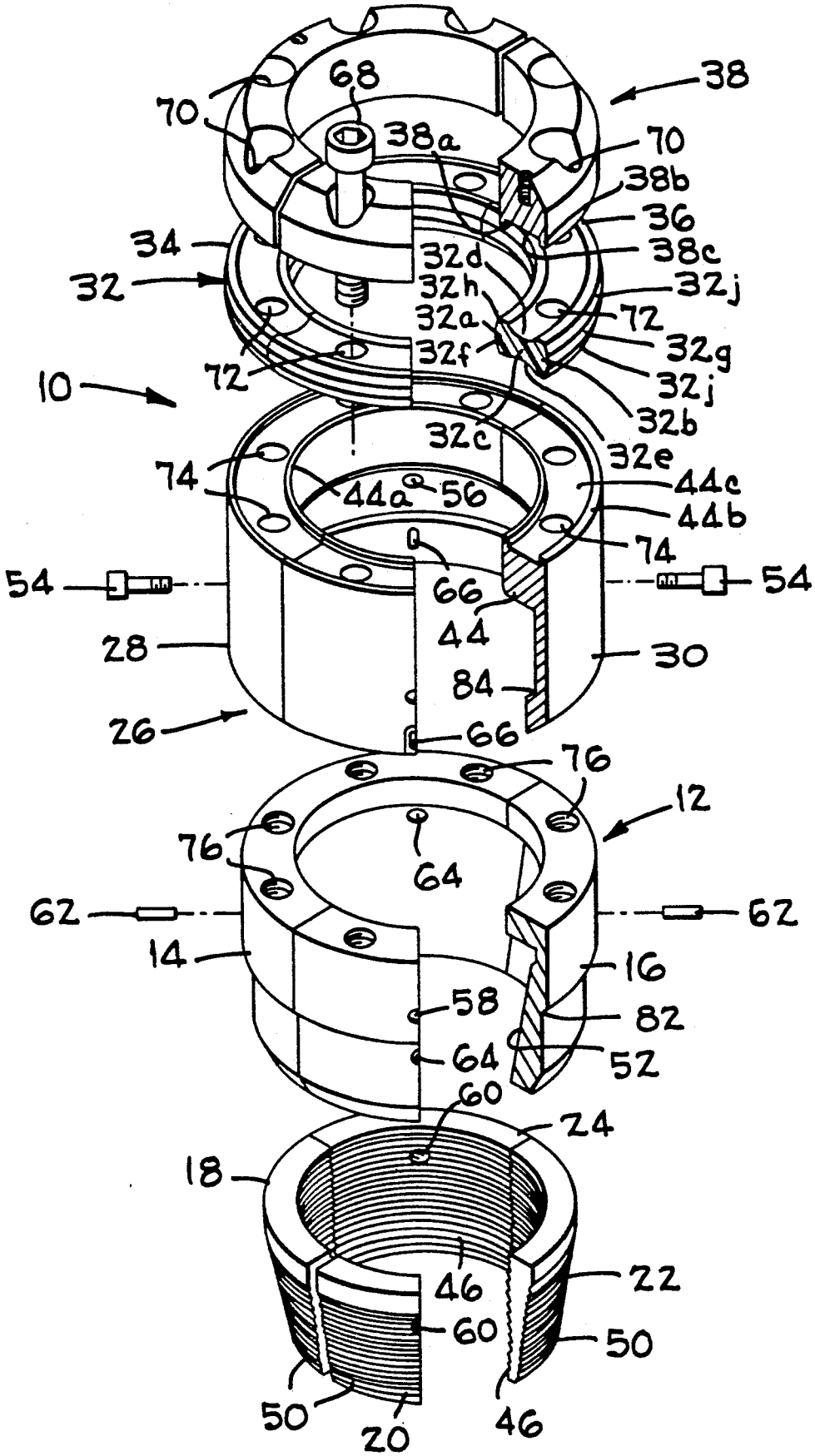
FIG. 1 is an exploded isometric view, partially in section, of a well casing hanger according to the present invention.

As seen best in FIG. 1, a casing hanger 10 according to the present invention comprises an annular assembly including a slip bowl 12 formed by two semicircular bowl elements 14, 16, four arcuate segmented slips 18, 20, 22, 24, a false bowl 26 formed by two semicircular bowl elements 28, 30, an elastomeric seal 32 formed by two semicircular seal elements 34, 36, and an upper junk ring 38 formed by two semicircular ring elements 40, 42. The radially enlarged upper portion of the false bowl elements 28, 30 functions as a lower junk ring 44 that cooperates with the upper junk ring 38 in retaining the seal ring 32 in place when the hanger is assembled as shown in FIG. 2.

Figure 2:
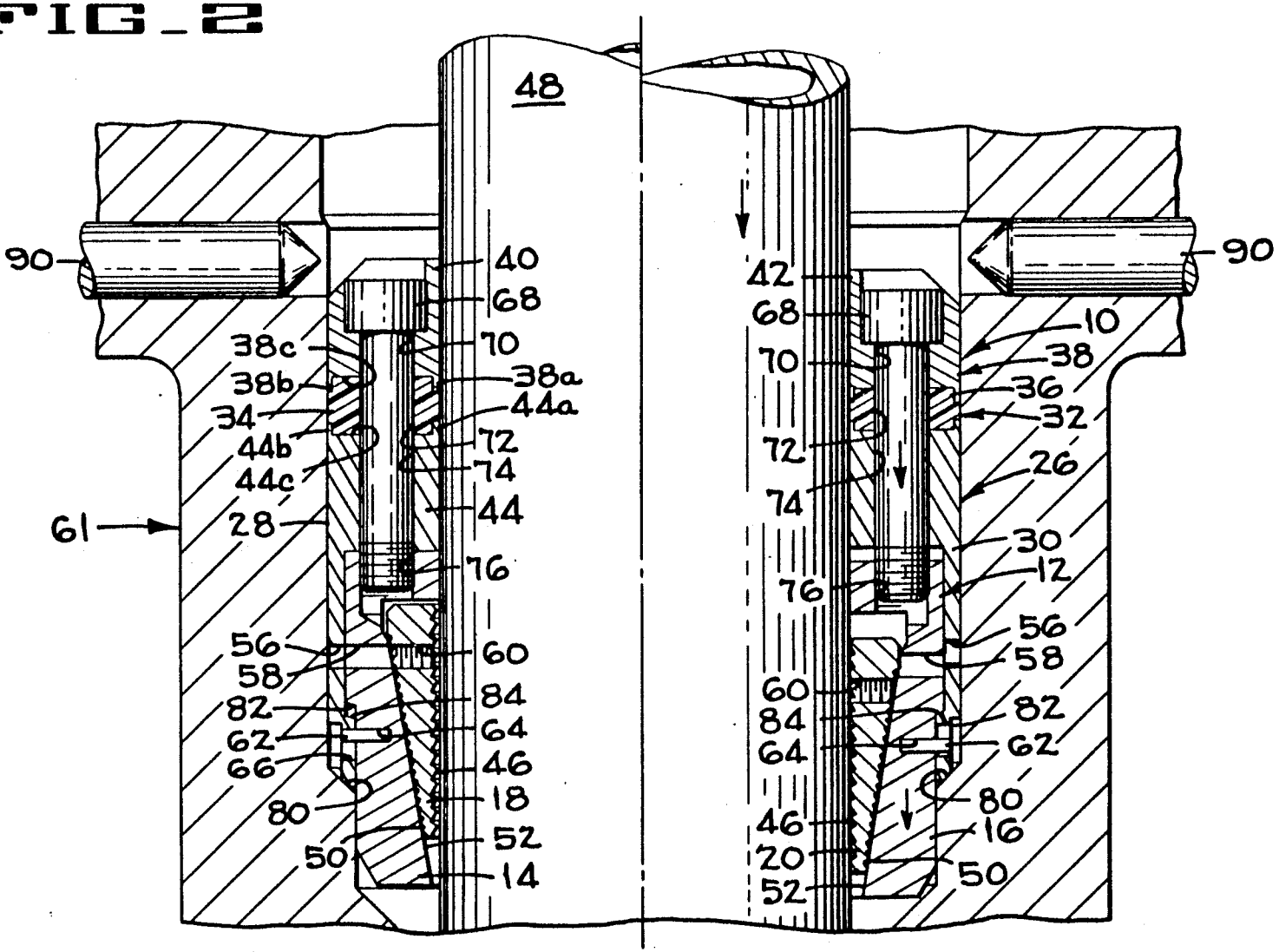
FIG. 2 is a central vertical section through the assembled casing hanger of FIG. 1, the left half of FIG. 2 showing the hanger landed in a casing head but prior to engagement of the hanger slips with the casing, and the right half of FIG. 2 showing the final positions of the hanger elements upon completion of the installation procedure.

The slips 18, 20, 22, 24 have a helically formed tooth profile 46 on their inner surface to catch and grip the casing 48 (FIG. 2), and a helically formed tooth profile 50 on their outer surface which engages the inner frusto-conical surface 52 of the slip bowl to limit the radial load applied to the casing 48 as the slips and casing descend to their final position as shown in the right half of FIG. 2, thereby preventing casing collapse or deformation of the casing internal diameter below the required drift diameter. Each of the slips 18, 20, 22, 24 is temporarily held in place against the adjacent slip bowl inner surface by a cap screw 54 (FIG. 1, only two shown) that extends through a hole 56 in the false bowl, a hole 58 in the slip bowl, and into a threaded bore 60 in the slip. After the hanger assembly 10 has been installed around the casing, and before the assembly 10 is lowered into the casing head 61 (FIG. 2), the cap screws 54 are removed.

The false bowl 26 and the slip bowl 12 are held together for limited relative axial movement by four circumferentially spaced pins 62 (only two shown) that reside in radial bores 64 in the slip bowl and axially elongated slots 66 in the false bowl. Eight circumferentially spaced cap screws 68 extend axially through holes 70 in the upper junk ring 38, holes 72 in the annular seal 32, and holes 74 in the lower junk ring 44 into threaded bores 76 in the upper end of the slip bowl 12, to hold these hanger elements together as shown in the left half of FIG. 2.

Both upper and lower junk rings have inner and outer axially extending annular lips 38*a*, 38*b*, 44*a*, 44*b*, which lips deform under pressure to limit extrusion of the annular elastomeric seal 32. This deformation is a result of the energizing pressure in the seal 32, and eliminates the relatively large annular extrusion gaps created by the increased tolerance range on the casing.

The annular seal 32 has a geometrically unique shape in cross-section that allows for proper thermal expansion and contraction to seal off pressure in the annulus between the casing 48 and the casing head 61 (FIG. 2). As seen in FIG. 1, the seal 32 includes inner and outer circumferential portions 32*a*, 32*b* interconnected by a central web portion 32*c* of less axial dimension than that of the end portions, whereby the concave upper and lower surfaces 32*d*, 32*e* of the web portion 32*c* are spaced axially from the adjacent flat end surfaces 38*c*, 44*c* of the upper and lowe junk rings. The seal 32 also has inner and outer cylindrical surfaces 32*f*, 32*g* which terminate in chamfered edges 32*h*, 32*j*. When the weight of the casing 48 (FIG. 2) is imposed on the hanger 10 it causes axial movement of the upper junk ring 38 toward the lower junk ring 44. As this movement occurs the seal 32 is deformed by axial compression into the cross-sectional shape shown in the right half of FIG. 2, and when this movement or stroke has reached its predetermined limit the resulting internal stress in the elastomer at the annular sealing locations maintains a pressure-tight fluid seal in both directions over the entire temperature range to which the seal 32 is exposed.

When the casing hanger 10 is installed the slips 18, 20, 22, 24 are in an elevated position in the slip bowl 12 as shown in the left half of FIG. 2, whereby they are prevented from applying radial contact pressure to the casing 48. The hanger 10 is slid down the casing 48 until the false bowl 26 comes to rest on an inner annular shoulder 80 of the casing head 61. The casing 48, which at this point is still being supported by the hoisting structure of the drilling rig (not shown), is lifted to obtain the desired hang off load, and the frusto-conical surface 52 of the slip bowl 12 facilitates upward movement of the casing 48 with respect to the hanger 10.

When the casing moves downward it is caught by the toothed surface 46 of the slips and carries them down the slip bowl surface 52, increasing the contact force of the slips to the casing and transferring the support load through the slips to the slip bowl 12. As this occurs the slip bowl 12 moves downward until its outer annular load shoulder 82 contacts and comes to rest on the inner annular load shoulder 84 of the false bowl 26, thereby transferring all casing load directly to the casing head 61 through the slips, slip bowl and false bowl (right half of FIG. 2).

Until the slip bowl shoulder 82 contacts the false bowl shoulder 84 the casing load is transferred from the slip bowl to the upper junk ring 38 by the cap screws 68. This load is transferred from the upper junk ring to the seal 32, creating a compressive pressure on the seal that energizes the elastomer and produces the bi-directional fluid barrier between the casing 48 and the casing head 61. As will be understood, the amount of seal compression is governed by the amount of travel required by the slip bowl until its shoulder 82 lands and sets on the false bowl shoulder 84.

In some situations the supported casing load may be less than that required to set the slip bowl shoulder 82 on the false bowl shoulder 84, such as can occur on shallow or low pressure wells where the casing string is relatively short and light in weight. Under these circumstances the required compression of the seal 32 can be obtained by increasing the torque on the cap screws 68, or by forcing the upper junk ring 38 downward with angled tip lock down screws 90 in the known manner.

Although the best mode contemplated for carrying out the present invention has been herein shown and described, may be made without departing from what is regarded to be the subject matter of the invention.

What is claimed is:

1. A well casing hanger assembly for supporting a well casing in a wellhead or other surrounding element and effecting and maintaining a bi-directional fluid seal between said casing and element over a wide range of temperatures, the hanger assembly comprising:

(a) plurality of arcuate slips;

(b) an annular slip bowl with an outer annular shoulder, and a frusto-conical inner surface against which the slips reside;

(c) a false bowl with an inner annular shoulder, said false bowl surrounding the slip bowl;

(d) a lower junk ring above the false bowl;

(e) an upper junk ring above the lower junk ring; and (f) an annular elastomeric seal element between the upper and lower junk rings;

said slip bowl shoulder and said false bowl shoulder cooperating to axially support said slip bowl on said false bowl when the hanger assembly is in its set position, the aforesaid elements (a) through (e) cooperating to apply a pre-determined initial portion of the casing hang load axially onto the seal element to axially compress and energize said seal element as the hanger assembly is being installed in proper functional position between a casing and a surrounding well element, and then to transfer the remainder of that hang load from the casing directly through said slips, slip bowl and false bowl onto said surrounding well element.

2. A well casing hanger assembly according to claim 1 wherein the shoulders are spaced apart axially a predetermined amount before the casing hang load is imposed on the slips, and wherein the slip bowl moves downward upon said imposition of the casing hang load until the slip bowl shoulder comes to rest upon the false bowl shoulder.

3. A well casing hanger assembly according to claim 1 wherein the upper and lower junk rings have inner and outer annular lips extending axially from said rings to limit extrusion of the seal element from between the rings.

4. A well casing hanger assembly according to claim 1 wherein the seal element has inner and outer circumferential portions interconnected by a central web portion of less axial dimension than the inner and outer portions, and the web portion has concave upper and lower radial surfaces.

5. A well casing hanger assembly according to claim 1 wherein the seal element has inner and outer cylindrical surfaces with upper and lower chamfered edges.

6. A well casing hanger assembly according to claim 1 wherein the false bowl and the lower junk ring are integral.

7. A well casing hanger assembly according to claim 1 including a plurality of circumferentially spaced cap screws extending axially through the upper junk ring, seal element and lower junk ring into threaded engagement with the slip bowl to hold the junk rings and seal element in proper position on the slip bowl while facilitating movement of the upper junk ring towards the lower junk ring to compress and deform the seal element as the slip bowl moves axially away from the lower junk ring in response to imposition of the casing hang load on the slips.

8. A well casing hanger assembly for supporting a well casing in a wellhead or other surrounding element and effecting and maintaining a bi-directional fluid seal between said casing and element over a wide range of temperatures, the hanger assembly comprising:

(a) a plurality of arcuate slips;

(b) an annular slip bowl with a frusto-conical inner surface against which the slips reside, said slip bowl having an outer annular shoulder;

(c) a false bowl surrounding the slip bowl, said false bowl having an inner annular shoulder, said inner and outer annular shoulders being axially spaced a pre-determined amount prior to imposition of a casing hang load on said slips, said inner and outer annular shoulders cooperating to axially support the slip bowl on the false bowl when said slip bowl moves downward upon said imposition of the casing hang load and said outer annular shoulder comes to rest upon said inner annular shoulder;

(d) a lower junk ring above the false bowl;

(e) an upper junk ring above the lower junk ring and (f) an annular elastomeric seal element between the upper and lower junk rings; the aforesaid elements a) through e) cooperating to deform and energize the seal element a pre-determined amount regardless of the casing hang load imposed thereon when the hanger assembly is installed in proper functional position between a casing and a surrounding well element, and then to transfer that hang load from the casing directly through said slips, slip bowl and false bowl onto said surrounding well element.

* * * * *